US010253607B2

(12) United States Patent
Lumbye et al.

(10) Patent No.: US 10,253,607 B2
(45) Date of Patent: Apr. 9, 2019

(54) METHOD FOR TREATING AND PRODUCING FROM A SUBTERRANEAN REGION

(71) Applicant: MAERSK OLIE OG GAS A/S, Copenhagen K (DK)

(72) Inventors: Peter Lumbye, Doha (QA); Mikkel Laurentzius, Doha (QA); Ioanna Doimas, Vrilissia (GR); Hans-Henrik Kogsboll, Gentofte (DK)

(73) Assignee: MAERSK OLIE OG GAS A/S, Copenhagen K (DK)

( * ) Notice: Subject to any disclaimer, the term of this patent is extended or adjusted under 35 U.S.C. 154(b) by 0 days.

(21) Appl. No.: 14/653,706

(22) PCT Filed: Dec. 19, 2013

(86) PCT No.: PCT/EP2013/077513
§ 371 (c)(1),
(2) Date: Jun. 18, 2015

(87) PCT Pub. No.: WO2014/096271
PCT Pub. Date: Jun. 26, 2014

(65) Prior Publication Data

US 2015/0345266 A1 Dec. 3, 2015

(30) Foreign Application Priority Data

Dec. 19, 2012 (GB) ..... 1222953.0

(51) Int. Cl.
*E21B 43/16* (2006.01)
*E21B 37/06* (2006.01)
(Continued)

(52) U.S. Cl.
CPC ..... *E21B 43/16* (2013.01); *E21B 33/06* (2013.01); *E21B 34/06* (2013.01); *E21B 34/063* (2013.01);
(Continued)

(58) Field of Classification Search
CPC ..... E21B 43/16; E21B 33/06; E21B 34/10; E21B 37/06; E21B 34/06; E21B 34/12;
(Continued)

(56) References Cited

U.S. PATENT DOCUMENTS 3,215,204 A * 11/1965 Sims ..... E21B 7/061 166/117.5
2002/0117301 A1* 8/2002 Womble ..... E21B 43/045 166/278
(Continued)

OTHER PUBLICATIONS

Office Action for corresponding Danish Application No. PA 2014 70499, dated Aug. 27, 2015.
(Continued)

*Primary Examiner* — Silvana C Runyan
(74) *Attorney, Agent, or Firm* — Harness, Dickey & Pierce, P.L.C.

(57) ABSTRACT

A method for treating a subterranean region includes running a tubular string including a plurality of sealed fluid ports distributed along its length through an upper lined wellbore section and into a lower drilled bore section which intercepts a subterranean region, wherein the lower drilled bore section includes a first fluid. A second fluid is delivered through one of the tubular string and an annulus defined between the tubular string and a wall of the bore to displace the first fluid from the annulus, wherein fluid communication between the tubular member and the annulus is provided via a displacement port in a lower end region of the tubular string. At least one of the sealed fluid ports may subsequently be opened and a treating fluid is delivered
(Continued)

through the tubular string and into the annulus via the at least one opened fluid port to treat the subterranean region.

47 Claims, 4 Drawing Sheets

(51) Int. Cl.

| | |
|---|---|
| ***E21B 34/10*** | (2006.01) |
| ***E21B 34/06*** | (2006.01) |
| ***E21B 34/12*** | (2006.01) |
| ***E21B 33/06*** | (2006.01) |
| ***E21B 43/25*** | (2006.01) |
| ***E21B 43/28*** | (2006.01) |
| ***E21B 43/14*** | (2006.01) |
| ***E21B 43/26*** | (2006.01) |
| *E21B 34/00* | (2006.01) |

(52) U.S. Cl.
CPC ..... *E21B 34/10* (2013.01); *E21B 34/12* (2013.01); *E21B 37/06* (2013.01); *E21B 43/14* (2013.01); *E21B 43/162* (2013.01); *E21B 43/25* (2013.01); *E21B 43/26* (2013.01); *E21B 43/28* (2013.01); *E21B 43/283* (2013.01); *E21B 2034/007* (2013.01)

(58) Field of Classification Search
CPC ..... E21B 34/063; E21B 43/26; E21B 43/14; E21B 43/283; E21B 43/25; E21B 43/162; E21B 2034/007
See application file for complete search history.

(56) References Cited

U.S. PATENT DOCUMENTS

| | | | | |
|---|---|---|---|---|
| 2004/0099418 | A1* | 5/2004 | Behrmann | E21B 21/00 166/312 |
| 2005/0230107 | A1* | 10/2005 | McDaniel | E21B 43/25 166/249 |
| 2005/0274522 | A1* | 12/2005 | Surjaatmadja | E21B 43/26 166/308.1 |
| 2006/0231253 | A1* | 10/2006 | Vilela | E21B 37/08 166/278 |
| 2008/0210429 | A1 | 9/2008 | McMillin et al. | |
| 2009/0114385 | A1* | 5/2009 | Lumbye | E21B 43/28 166/250.01 |
| 2009/0294122 | A1 | 12/2009 | Hansen et al. | |
| 2011/0127047 | A1* | 6/2011 | Themig | E21B 34/063 166/386 |
| 2011/0220361 | A1 | 9/2011 | Huang | |

OTHER PUBLICATIONS

International Search Report PCT/ISA/210 for International Application No. PCT/EP2013/077513 dated Oct. 8, 2014.

* cited by examiner

METHOD FOR TREATING AND PRODUCING FROM A SUBTERRANEAN REGION

FIELD OF THE INVENTION

The present invention relates to a method and apparatus for use in treating a subterranean region which is intercepted by a drilled bore.

BACKGROUND TO THE INVENTION

In the oil and gas exploration and production industries wellbores are drilled from surface to intercept subterranean formations or reservoirs. These wellbores may be used to produce fluids, such as oil and gas, from a subterranean reservoir to surface. Further, these wellbores may be used to inject a fluid, such as water or gas, into a subterranean region, for example for disposal, to assist in recovery of a further fluid to surface, and the like.

Wellbores are typically formed in stages, with a first section drilled with a drill bit mounted on the end of a drill string, and the drilled section then lined with casing which is cemented in place for sealing and support. Following this a drill string with a smaller diameter drill bit is run through the cased first section to advance the bore, with the further drilled section also lined with casing. This process is repeated until the bore intercepts the target formation or reservoir, with the reservoir section of the bore typically being lined with a reservoir liner, and cemented in place, and/or sealed via liner packers. As each new bore section is drilled with a drill bit of reducing diameter to permit passage of the drill string and casing/liner through the previous cased section, the diameter of the wellbore decreases with bore depth. In some cases the reservoir liner may define a diameter of, for example, 178 mm (7").

During each drilling stage a drilling fluid, known as drilling mud, is circulated through the bore. This drilling mud has multiple functions, such as to lubricate and cool the drill bit, to carry drill cuttings back to surface, and to control the hydrostatic pressure within the bore and establish a desired balance between the bore pressure and surrounding reservoir pressure to minimise the risk of inflow from the formation during this bore forming stage.

Once the reservoir section is lined, this may be perforated at various locations along its length to establish fluid communication between the reservoir and the wellbore. Where the wellbore is required for producing reservoir fluids to surface a production completion is installed, which includes a production tubing string with multiple in-flow ports along its surface to facilitate entry of reservoir fluids to be communicated to surface.

In many instances efficient production rates can only be achieved if the reservoir is first stimulated. Many stimulating techniques are known, such as fracturing and acid stimulation, which usually function to effectively increase the porosity of the reservoir, especially in the near wellbore region which may have suffered damage during drilling. The present applicant has developed a technique known as the Perforate, Stimulate and Isolate (PSI) completion system, in which individual sealed zones within the perforated liner are established by use of a number of packers mounted on the production string. The production string includes sliding sleeves which are opened to permit outflow of a stimulating fluid, such as an acid, fracturing fluid and the like, into each isolated zone and ultimately into the reservoir via the liner perforations. These sliding sleeves are typically operated by coiled tubing extended from surface, and as such the total length of this type of completion is restricted to the reach of the coiled tubing.

To maximise the interface area between the wellbore and the reservoir, and therefore maximise recovery rates, it is common practice to form extended lateral or horizontal wellbore sections. For example, such lateral wellbores are extensively used in the Dan/Halfdan oil accumulation, offshore Denmark. However, the extent of such lateral wells may be limited by the desired or required completion techniques. For example, the PSI completion system, as noted above, is limited by the maximum reach of coiled tubing. Also, in some circumstances, although a bore may be drilled to a significant depth it may not be possible to line or case the bottom part of such a bore with a conventional cemented reservoir liner, and subsequently perforate this to establish communication with the reservoir.

It has been proposed in the art to leave extended reach sections of a bore unlined or open, and permit communication of reservoir fluids directly through the bore/reservoir interface region. However, it is extremely difficult to stimulate such open hole sections, for example due to the complexity and often the inability to run and install completion equipment at such depths. Also, as noted above, the process of drilling the bore often has a detrimental effect on the bore/reservoir interface region, causing damage in the near-wellbore region, resulting in a reduction in porosity and permeability and thus restricting inflow of reservoir fluids. This damage or reduction in porosity and permeability is often termed the wellbore skin, and must be addressed to ensure efficient and maximum production rates are achieved.

For example, the drilling fluid or mud used during the drilling process may form a layer or coating on the surface of the bore, called mud or filter cake, which presents a restriction to inflow from the reservoir. This mud cake must be removed to improve the rate of inflow from the reservoir, and again difficulties exist due to the depths involved.

The present applicant has developed a technique for use in stimulating extended reach reservoir sections, which is disclosed in EP 1 184 537, US 2009/0294122 and in SPE paper 78318 entitled "Controlled Acid Jet (CAJ) Technique for Effective Single Operation Stimulation of 14,000+ft Long Reservoir Sections". The disclosure of each of these documents is incorporated herein by reference. This technique involves running a liner, called a Controlled Acid Jet (CAJ) liner, into a drilled bore which extends beyond an existing lined bore section, wherein the CAJ liner is sealed against the upper liner. The CAJ liner includes a number of pre-drilled holes extending through its wall, which permit an acid pumped from surface to exit the CAJ liner and into the annulus between the liner and the bore wall. This acid functions to break down the mud cake and then flow into the reservoir to stimulate the reservoir.

In this known technique, however, the fluid, such as drilling mud, resident in the bore prior to running in the CAJ liner cannot be circulated out, and is effectively also displaced into the formation with the acid. This may require increased volumes of acid to be used, and may result in a degree of dilution of the acid, making it less effective. Further, the inability to circulate the resident fluid from the annulus may result in this fluid eventually being produced to surface with the formation fluids, and thus necessitating its eventual separation from the formation and other fluids.

Blow Out Preventors (BOP) are commonly located at a wellhead of an oil or gas well to control or seal the well in the event of a sudden pressure increase or "kick" in the wellbore such as may occur during drilling operations as a result of a sudden in-flow of fluid from a formation surrounding the well. One known type of BOP may comprise one or more pairs of rams for sealing the well. For example, known types of BOPs may comprise one or more pairs of pipe rams, one or more pairs of blind rams and/or one or more pairs of shear rams. Pipe rams may be employed to seal against a tubular string which extends through the BOP so as to seal an annulus defined between an outer surface of the tubular string and a sidewall of the wellbore. Blind rams may be used to seal the well when there is no tubular string extending through the BOP. Shear rams are generally capable of shearing a tubular string such as a drill string or a running string that extends through the BOP. Shear rams are generally only employed as a last resort to control the well in an emergency when it is not possible or it is not appropriate to seal the well using pipe rams and/or blind rams. Shearing a tubular string using shear rams is undesirable for several reasons. For example, it can be difficult and time-consuming to retrieve the lower part of the tubular string after shearing. The shearing process is destructive and it is necessary to replace the tubular string after shearing. Furthermore, the shear rams of the BOP may also need to be inspected and/or replaced after shearing.

CAJ liners are commonly deployed through a BOP. However, in the event of a pressure kick in the wellbore, it is not possible to seal the well using pipe rams because fluid would be able to the bypass the pipe rams via the ports of the CAJ liner. Accordingly, it is known to drop the CAJ liner through the BOP to facilitate closing of BOP blind rams for control of the well. In practice, however, this known technique may only be reliable for CAJ liners of a length which is limited to a length of the existing lined section of the wellbore. This is because dropping the CAJ liner through the BOP may have the result that the CAJ liner will fall relative to the existing lined section of the wellbore and stick or jam on a sidewall of the open hole section located below a downhole end of the lined section of the wellbore. If the CAJ liner length exceeds the length of the existing lined section of the wellbore, an upper end of the CAJ liner may then continue to protrude upwardly from the BOP thus preventing the use of blind rams or pipe rams for sealing the well. Under such circumstances, it may be necessary to employ BOP shear rams to shear the CAJ liner for control of the well. It is, however, normally unacceptable well control practice to rely solely on shear rams as means of securing the well. It is also undesirable because it may be difficult and time-consuming to retrieve the lower part of the CAJ liner after shearing, it may be necessary to replace the CAJ liner after shearing, and because the shear rams of the BOP may need to be inspected and/or replaced after shearing the CAJ liner.

SUMMARY OF THE INVENTION

According to a first aspect of the present invention there is provided a method for treating a subterranean region, comprising:

running a tubular string comprising a plurality of sealed fluid ports distributed along its length through an upper lined wellbore section and into a lower drilled bore section which intercepts a subterranean region, wherein the lower drilled bore section includes a first fluid;

providing fluid communication between the tubular string and an annulus defined between the tubular string and a wall of the bore via a displacement port in a lower end region of the tubular string;

delivering a second fluid into the lower drilled bore section via one of the annulus and the tubular string to displace the first fluid from the annulus;

subsequently opening at least one of the sealed fluid ports; and delivering a treating fluid through the tubular string and into the annulus via the at least one opened fluid port to treat the subterranean region.

Terms such as "upper", "lower", "upwardly", "downwardly", "below" and "above", and other similar terms, should be assumed in relation to the entry point of a bore, such that a region or section nearer to an entry point may be defined as an upper region, and a region further from an entry point may be defined as a lower region. In this respect, the drilled bore may extend vertically, horizontally, and/or inclined.

In use, the present invention permits a first fluid which is initially present within the drilled bore to be displaced, with one or more ports in the tubular string subsequently opened to facilitate treatment of the subterranean region. Accordingly, the ports in the tubular string are intended to remain closed and sealed during displacement of the first fluid, such that the ports do not interfere or prevent this ability to displace the first fluid. Further, the ability to displace the first fluid prior to opening at least one port to initiate treatment may prevent the first fluid from interfering with the intended treatment. For example, the ability to displace the first fluid may permit a more direct treatment to be achieved. Further, displacing the first fluid from the annulus may eliminate any requirement to displace this first fluid into the surrounding geology during the intended treatment.

The displacement port may provide initial communication between the annulus and the tubular string to facilitate displacement of the first fluid, prior to opening of at least one sealed fluid port.

In one embodiment the second fluid may be delivered downwardly through the tubular string to displace the first fluid upwardly through the annulus. Such an arrangement may be defined as forward or short circulation. In such an arrangement the second fluid, and any first fluid contained within the tubular string, may pass from the tubular string and into the annulus via the displacement port.

In one embodiment the second fluid may be delivered downwardly though the annulus to displace the first fluid upwardly through the tubular string. Such an arrangement may be defined as reverse or long circulation. In such an arrangement the first fluid may pass from the annulus and into the tubular string via the displacement port.

The method may comprise displacing the first fluid to surface level for disposal, treatment, reuse or the like.

The method may comprise using the treating fluid to treat a portion of the drilled bore. In such an arrangement the drilled bore may be considered to form part of the subterranean region. The treating fluid may be used to treat a wall surface of the drilled bore. The treating fluid may be used to remove a material, such as mud cake, deposited on the wall surface of the bore. Such removal treatment may be achieved by mechanically displacing the deposited material, for example by establishing jetting of the treating fluid from the at least one opened fluid port onto the deposited material. Such removal treatment may comprise a chemical treatment, such as dissolving or the like, of the deposited material.

The method may comprise using the treating fluid to treat a portion of the surrounding geology or rock structure. For example, the treating fluid may flow from the annulus between the tubular string and the bore wall into the surrounding geology. The pressure of the treating fluid may be elevated to permit flow from the annulus into the surrounding geology.

In use, the tubular string may be positioned to extend below the upper lined wellbore section. This upper lined wellbore section may be perforated or otherwise presented in communication with a surrounding subterranean formation. In such an arrangement the upper lined wellbore section may be configured to support production and/or injection between the liner and surrounding formation. The upper lined wellbore section may accommodate a production completion system, injection completion system or the like.

The tubular string may be mounted to a liner secured in the upper wellbore section. The tubular string may be mounted or secured to the liner of the upper wellbore section via a tubing hanger.

The tubular string may be mounted to the liner of the upper wellbore section such that fluid communication between said liner and tubular string is permitted to allow the first fluid to be displaced from the lower drilled bore. Such fluid communication may permit upward flow of the first fluid from the annulus, and/or permit downward flow of the second fluid into the annulus.

The method may comprise forming a seal between the tubular string and a liner of the upper wellbore section. The method may comprise forming a seal between the tubular string and a liner of the upper wellbore section following a desired displacement of the first fluid. Such an arrangement may allow the first fluid to be displaced from the annulus between the tubular string and bore wall, and then permit the annulus to be isolated. This isolation of the annulus may permit the treating fluid to be retained within the annulus for use in treating the intended subterranean region. Further, this isolation of the annulus may permit pressure within the annulus to be elevated or otherwise controlled, which may assist or facilitate treating of the subterranean region.

A seal between the liner and tubular string may be established via a packer. The seal may comprise a tubing hanger seal. The seal may comprise a mechanically actuated seal. The seal may comprise an inflatable seal. The seal may comprise a swellable seal. Such a swellable seal may be configured to swell upon exposure to the second fluid and/or the treating fluid.

The first fluid may comprise a wellbore completion fluid. The first fluid may comprise a drilling mud. The first fluid may include suspended particulate material, such as sand particles, drill cuttings and the like. Displacing the first fluid may also function to displace such particulate material.

The second fluid may comprise a substantially inert fluid. Such an inert fluid may have minimal chemical effect on the subterranean region. In such an arrangement the second fluid may be substantially inert relative to the subterranean region. Such an inert fluid may have minimal chemical effect when exposed or contacted with the first fluid. The second fluid may comprise an aqueous fluid, such as a brine, seawater, previously produced water or the like. The second fluid may be pre-treated to be chemically compatible with the subterranean region, for example without having a detrimental effect, or a significant detrimental effect on the subterranean region. For example, the second fluid may be pre-treated to remove specific precursor ions which may otherwise result in the formation of certain salts and the like, for example insoluble salts, within the drilled bore section.

The first and second fluid may be substantially immiscible. Such an arrangement may facilitate improved displacement of the first fluid by the second fluid.

The treating fluid may comprise or be defined by the second fluid. In such an arrangement the second fluid may be used to both displace the first fluid from the annulus, and to treat the subterranean region. The method may comprise ceasing delivery of the second fluid following displacement of the first fluid to permit at least one fluid port to be opened, and then re-initiating delivery of the second fluid to be communicated into the annulus via the opened port for treating the subterranean region. The method may comprise continuously delivering the second fluid during opening of at least one fluid port.

The treating fluid may comprise a third fluid which is different from the second fluid. In such an arrangement the third fluid may be delivered through the tubular string following the second fluid to permit treating of the subterranean region.

The treating fluid may be configured for cleaning within the subterranean region, for example to remove deposited materials, such as mud cake. The treating fluid may be configured to clean the at least one opened fluid port in the tubular string. The treating fluid may be configured for stimulating the surrounding geology, for example to assist flow of a fluid from the surrounding geology into the lower drilled bore section. The treating fluid may be used to fracture the surrounding geology, for example to hydraulically fracture, chemically fracture or the like the surrounding formation.

The treating fluid may comprise a fracturing fluid. The treating fluid may comprise or carry a proppant. The treating fluid may comprise a chemical or chemical composition. The treating fluid may comprise a reagent. The treating fluid may comprise an acid or other aggressive fluid. Such an acid or other aggressive fluid may function to break-up a deposited material, such as mud cake within the lower drilled bore section. Such acid or other aggressive fluid may be for use in acid matrix stimulation of the surrounding geology. The treating fluid may comprise hydrochloric acid. The treating fluid may comprise a corrosion inhibitor, for example to assist to inhibit corrosion of the tubular string and/or other infrastructure located with the bore.

The method may comprise opening all sealed fluid ports of the tubular string to permit communication of the treating fluid into the annulus along the length of the tubular string. Such an arrangement may permit a more uniform delivery of the treating fluid along the length of the tubular string.

The fluid ports may be evenly distributed along the length of the tubular string.

The fluid ports may be unevenly distributed along the length of the tubular string. Such an uneven distribution may facilitate a more even distribution of the treating fluid into the annulus via the ports. In one embodiment the geometric distribution of the fluid ports may be such that the average axial spacing of the fluid ports decreases towards the lower end region of the tubular string. This may compensate for the friction pressure drop as the treating fluid is delivered along the length of the tubular string towards the lowermost fluid ports.

The fluid ports may define a common diameter.

At least two fluid ports may define different diameters. This may assist in providing a more even distribution of the treating fluid into the annulus.

A single fluid port may be provided at any single axial location. Alternatively, multiple fluid ports may be provided at a common axial location, circumferentially distributed around the tubular string.

The method may comprise opening at least one fluid port by a chemical activation. Such chemical activation may be achieved by use of the second fluid and/or treating fluid.

The method may comprise opening at least one fluid port by a mechanical activation, for example by application of a mechanical force, for example via a tool, an actuation member, such as a dart or ball dropped or pumped along the tubular string, via a work string, coiled tubing, wireline, or the like.

The method may comprise opening at least one fluid port by a thermal activation, for example by application of heat.

The method may comprise opening at least one fluid port by a pressure activation, for example by application of a pressure differential between the tubular string and the surrounding annulus. Such a pressure differential may be achieved by controlling the pressure of the second fluid and/or treating fluid within the tubular string and the annulus. Such a pressure differential may be achieved by a back pressure developed by the displacement port in the lower end region of the tubular string, such that the tubular string pressure is elevated above the annulus pressure, thus achieving a pressure differential therebetween.

At least one sealed fluid port may be configured to resist a pressure differential between the tubular string and surrounding annulus to prevent premature opening of the port. At least one sealing port may be configured to resist a pressure differential between the tubular string and surrounding annulus which is associated with displacing the first fluid along the annulus. At least one sealed fluid port may be configured to resist a pressure differential of between, for example, 34 bar (500 psi) and 345 bar (5000 psi), such as between 138 bar (2000 psi) and 241 bar (3500 psi). An appropriate safety factor may be included in such resistance to a differential pressure, such as a safety factor of between 1 and 2, for example between 1 and 1.5, such as 1.2. In one embodiment, at least one sealed portion may be configured to resist a pressure differential of around 172 bar (2500 psi), with a safety factor of 1.2 such that a designed resistance to a pressure differential may be around 206 bar (3000 psi).

The method may comprise opening at least one fluid port after a predetermine lapse of time. Such a predetermined lapse of time may be sufficient to permit a desired displacement of the first fluid from the annulus. The predetermined lapse of time may comprise between 1 and 120 hours, for example between 24 and 72 hours, such as around 48 hours.

The method may comprise initially sealing the fluid ports by mounting a sealing assembly relative to each port. The method may comprise activating a sealing assembly to open the associated fluid port.

In one embodiment a sealing assembly may be mounted adjacent one or more ports, for example concentric with the tubular string, for example internally or externally of the tubular string. For example, the sealing assembly may comprise a sleeve associated with at least one fluid port and mounted concentrically with tubular member. In such an arrangement the sleeve may be moved from a first position in which the associated fluid port is closed, to a second position in which the associated fluid port is opened. Such movement may include axial movement of the sleeve. Such movement may include rotation of the sleeve. Such movement may be achieved by fluid pressure, mechanical intervention, by passing an actuation member, such as a ball or dart through the tubular string, or the like.

In one embodiment a sealing assembly may be mounted within each port. The sealing assembly may be threadedly engaged with a fluid port. The sealing assembly may be secured within the fluid port by an interference fit.

At least one sealing assembly may comprise or define a plug mounted within an associated fluid port.

At least one sealing assembly may comprise or define a removable fluid barrier. At least one sealing assembly may be activated to remove the fluid barrier, or at least the effect of the removable barrier.

The method may comprise mechanically activating a sealing assembly to open the associated fluid port.

The method may comprise thermally activating a sealing assembly to open the associated fluid port.

The method may comprise chemically activating a sealing assembly to open the associate fluid port.

The method may comprise eroding at least a portion of the sealing assembly. For example, the second and/or treating fluid may comprise an abrasive material, such as proppant material, which may function to erode at least a portion of the sealing assembly.

The method may comprise chemically degrading, for example dissolving, at least a portion of a sealing assembly to open the associated fluid port. To facilitate this at least a portion of the sealing assembly may comprise a degradable, for example dissolvable, material. Such an arrangement may facilitate a substantially passive mechanism for opening a fluid port. This may be particularly advantageous in circumstances where the lower drilled bore section extends to a significant depth, for example beyond 5486 m (18,000 feet), which may make physical intervention from surface level difficult.

The method may comprise chemically degrading at least a portion of a sealing assembly by use of the second fluid and/or treating fluid. In such an arrangement a sealing assembly may comprise a material which is degraded upon exposure to the second fluid and/or the treating fluid.

The method may comprise chemically degrading at least a portion of a sealing assembly over a predetermined time period prior to eventual opening of the associated fluid port. In this arrangement the degradable portion of the sealing may be specifically designed to permit such degrading over the predetermined time. For example, the geometry, such as thickness, exposed surface area and the like may be selected to permit chemical degradation over the predetermined time.

At least one assembly may comprise a valve assembly.

At least one sealing assembly may comprise a frangible component configured to be broken to permit the associated fluid port to be opened. The method may comprise breaking the frangible component to open the associate flow port.

The frangible component may be configured to be broken by an applied mechanical force. Such a mechanical force may be applied by a separate tool, such as a tractor apparatus deployed through the tubular string.

The frangible component may be configured to be broken, or burst, upon exposure to a pressure differential, such as a pressure differential between the tubular string and the surrounding annulus.

The tubular string may be radially expanded to define a larger diameter when located within the lower drilled bore section. Such expansion may be achieved by elevating the pressure within the tubular string. Such expansion may be achieved using an expansion tool, such as an expansion cone, rolling expansion tool, inflatable expansion tool or the like.

The method may comprise opening at least one sealed fluid port upon expansion of the tubular string at the region of said fluid port.

The tubular string may be vibrated to open at least one sealed fluid port. For example, in one embodiment a fluid port may be sealed with a fluid barrier, wherein the tubular string is vibrated at a natural frequency, or harmonic frequency, of the fluid barrier, causing said fluid barrier to permit the associated fluid port to open. In such an arrangement the fluid barrier may be dislodged. Such a fluid barrier may be broken up.

The tubular string may comprise a single displacement port in the lower end region thereof. The tubular string may comprise a plurality of displacement ports in the lower end region thereof.

The displacement port may be of any suitable shape, for example generally circular.

The displacement port may be larger than a fluid port.

The method may comprise maintaining the displacement port in the lower end region of the tubular string opened to permit delivery of the treating fluid therethrough.

The method may comprise closing the displacement port in the lower end region of the tubular string such that the treating fluid is restricted to flow only through the at least one opened fluid port. The method may comprise closing the displacement port before or at the same time as the sealed fluid ports are opened.

The method may comprise closing the displacement port using a valve assembly, such as a flapper valve assembly.

The method may comprise closing the displacement port using a sealing member, such as a ball, dart or the like, delivered through the tubular string to seal the displacement port.

The sealed fluid ports may be defined by drilled holes through the wall of the tubular string, where said drilled holes are subsequently sealed.

The tubular string may define a diameter which is less than the diameter of the upper lined bore section. The tubular string may define a diameter of between around 100 mm (4 inches) and 178 mm (7 inches), for example around 127 mm (5 inches).

The tubular string may be of any suitable length. In some embodiments the tubular string may extend between around 1524 m (5000 feet) and 4572 m (15,000 feet). Accordingly, the present invention may permit exploitation of significant bore depths which might otherwise not be accessible, for example by use of conventional cemented liner based completions.

The method may comprise running the tubular string into the lower drilled bore section on a running string. The running string may facilitate communication of fluids, such as the first fluid, second fluid and/or the treating fluid to/from the tubular string.

The tubular string may be defined by any object which is tubular in nature.

The tubular string may be provided as a continuous length of tubing.

The tubular string may be defined by multiple tubular members coupled together in end-to-end relation, for example by threaded connections, welded connection or the like, to define the tubular string. The method may comprise making-up the tubular string using individual tubular members.

Each tubular member of the tubular string may define or comprise a fluid port. Selected tubular members of a tubular string may define or comprise a fluid port. In one embodiment the tubular string may comprise a plurality of non-ported tubular members and a plurality of ported tubular members. The ported tubular members may be inserted into the tubular string as required, for example to provide a required distribution of the ports along the length of the tubular string. The ported tubular members may each define a pup joint. The ported tubular members may comprise opposing end connectors, such as threaded end connectors, to permit connection with the tubular string.

The method may comprise isolating at least one individual region or zone within the lower bore section, and treating the subterranean region within said isolated zone via the tubular string. The method may comprise isolating a region within the tubular member. Such isolation within the tubular member may be achieved via one or more plugs or the like. The method may comprise isolating a region within the annulus formed between the tubular string and bore wall. Such annulus isolation may be achieved via one or more packers or the like.

The method may comprise permitting a fluid, such as oil, gas, water and the like to flow from the surrounding geology into the annulus and into the tubular string via the at least one opened port, following treatment of the subterranean region. This arrangement may permit the tubular string to facilitate production of a fluid from the subterranean region. Produced fluids may be communicated towards surface via the tubular string. Produced fluids may be communicated into the upper lined bore section via the tubular string. In such an arrangement the produced fluids may be collected via a production completion installed within the upper lined bore section.

The method may comprise isolating at least one region or zone within the lower drilled bore section to prevent or minimise production from said isolated zone. Such an arrangement may be used to, for example, minimise production of undesired fluids, such as water or gas, from such an isolated zone.

The method may comprise permitting a fluid, such as gas, water or the like, to be injected into the surrounding geology via the at least one opened port in the tubular string, following treatment of the subterranean region.

The method may comprise running the tubular string through a well control barrier or apparatus. Such a well control barrier or apparatus may be provided at or in the region of an entry point into the wellbore.

The well control barrier may be configured to provide a seal against an outer surface of the tubular string.

The well control barrier may comprise a valve.

The well control barrier may comprise a Blow Out Preventor (BOP).

The method may comprise closing the well control barrier so as to provide a seal against an outer surface of the tubular string.

The method may comprise sealing an interior of the tubular string.

The method may comprise unsealing the interior of the tubular string and then continuing to run the tubular string through the well control barrier.

The method may comprise opening the well control barrier and continuing to run the tubular string through the well control barrier.

The method may comprise running the tubular string into the lower drilled bore section to a depth below a reach of coiled tubing.

The tubular string may function to prevent collapse, or prevent complete collapse of the drilled bore section.

The tubular string may comprise or define a Controlled Acid Jet (CAJ) liner.

According to a second aspect of the present invention there is provided an apparatus for treating a subterranean region, comprising:

a tubular string configured to extend below an upper lined bore section into a lower drilled bore section;

a displacement port located in an end region of the tubular string;

a plurality of fluid ports distributed along the length of said tubular string; and a plurality of sealing assemblies, each sealing assembly being associated with a corresponding fluid port of the tubular string, wherein at least one sealing assembly is configured to be activated to open the associated fluid port, wherein, in use, at least one sealing assembly is activated to open following circulation of a fluid between the tubular string and the lower drilled bore section via the displacement port.

Each sealing assembly may be located in a corresponding fluid port of the tubular string.

The apparatus according to the second aspect may be used in the method according to the first aspect, and any features defined in relation to the first aspect may be applied to the second aspect.

According to a third aspect of the present invention there is provided a tubular member, comprising:

opposing end connectors to permit connection with a tubular string:

a tubular wall structure extending between the opposing end connectors;

at least one fluid port extending through the tubular wall structure; and a sealing assembly configured to seal the at least one fluid port and be selectively opened upon exposure to an activator.

The tubular member according to the third aspect may be utilised to form part of the tubular string defined in relation to the first aspect. Any features defined in relation to the first aspect may be applied to the third aspect.

According to a fourth aspect of the present invention there is provided a well bore system, comprising:

upper and lower drilled bore sections;

a liner installed within the upper bore section and configured to permit communication between a surrounding formation and the liner; and an apparatus according to the second aspect extending below the liner and into the lower bore section.

Other aspects of the present invention may relate to methods and apparatus for completing a well bore.

It should be understood that any feature defined in relation to one aspect may be provided in combination with any other aspect.

According to a fifth aspect of the present invention there is provided a method for treating a subterranean region, comprising:

running a tubular string through a well control barrier and into a wellbore which intercepts a subterranean region, wherein the tubular string comprises a plurality of sealed fluid ports distributed along its length;

closing the well control barrier to provide a seal against an outer surface of the tubular string;

opening the well control barrier to release the tubular string;

continuing to run the tubular string through the well control barrier and into the wellbore until the tubular string reaches the subterranean region;

opening at least one of the sealed fluid ports; and delivering a treating fluid through the tubular string and into an annulus defined between the tubular string and the wellbore via the at least one opened fluid port to treat the subterranean region.

The method may comprise stimulating the subterranean region.

The method may comprise injecting fluid through the at least one opened fluid port for matrix stimulation or hydraulic fracturing of the subterranean region.

The method may comprise injecting acid through the at least one opened fluid port.

The tubular string may comprise a Controlled Acid Jet (CAJ) liner.

Closing the well control barrier may prevent the tubular string from continuing to run through the well control barrier.

The method may comprise interrupting running of the tubular string through the well control barrier before closing the well control barrier.

The well control barrier may comprise a valve.

The well control barrier may comprise a Blow Out Preventor (BOP).

The method may permit a seal to be formed against an outer surface of the tubular string in the event of an emergency such as a sudden pressure kick in the wellbore during the deployment of the tubular string into the wellbore. Such a method may be used regardless of a length of the tubular string. Such a method may avoid any requirement to shear the tubular string in the event of an emergency.

The method may comprise monitoring a condition of the wellbore during deployment of the tubular. For example, the method may comprise monitoring a fluid pressure in the wellbore during deployment of the tubular.

The method may comprise closing the well control barrier to seal against an outer surface of the tubular in response to a monitored condition falling outside an acceptable range.

The method may comprise opening the well control barrier in response to the monitored condition falling within the acceptable range.

The method may comprise taking remedial action in response to the monitored condition falling outside the acceptable range to thereby return the monitored condition to within the acceptable range.

The method may comprise injecting a fluid into the wellbore in response to the monitored condition falling outside the acceptable range.

The method may comprise injecting a fluid into the wellbore through a bypass port located below the well control barrier.

The method may comprise injecting a fluid into an interior of the tubular string. The method may comprise injecting a fluid into the interior of the tubular string and circulating fluid back to surface via a port such as a displacement port at a lower end of the tubular string and an annulus defined between the tubular string and the wellbore.

The method may comprise injecting a fluid into an annulus defined between the tubular string and the wellbore. The method may comprise injecting a fluid into the annulus and circulating fluid back to surface via a port such as a displacement port at a lower end of the tubular string and an interior of the tubular string.

The method may comprise injecting a fluid into the wellbore having a density greater than a density of fluid resident within the wellbore.

The method may comprise replacing, for example circulating, lower density fluid resident within the wellbore with higher density fluid. This may increase the density of fluid present in the wellbore to thereby increase hydrostatic pressure in the wellbore and suppress any flow of fluid from a formation surrounding the wellbore upwardly within the wellbore.

The method may comprise sealing an interior of the tubular string.

The method may comprise sealing an interior of the tubular string at a position at or adjacent an upper end of the tubular string.

Sealing the interior of the tubular string whilst the well control barrier is closed may serve to isolate the wellbore from a surface environment.

The method may comprise sealing an interior of the tubular string using an internal valve such as a flapper valve, a ball valve or the like.

The method may comprise sealing an interior of the tubular string using an Internal Blow Out Preventor (IBOP).

The method may comprise unsealing the interior of the tubular string and then continuing to run the tubular string through the well control barrier. This may permit any fluid trapped inside the tubular string during deployment to escape upwardly through the tubular string.

The method may comprise running the tubular string into an open hole section of the wellbore.

The method may comprise running the tubular string to a depth in the wellbore below a reach of coiled tubing.

The method may comprise permitting well fluid to enter the tubular string as the tubular string is run into the wellbore. Such a method may permit the tubular string to self-fill with well fluid.

The method may comprise permitting well fluid to enter the tubular string through a displacement port located at or adjacent a lower end of the tubular string.

The method may comprise opening a valve such as a flapper valve or the like which is configured to control the flow of well fluid through the displacement port.

The method may comprise injecting fluid into the tubular string.

The method may comprise injecting fluid into the tubular string via a port at or adjacent a top end of the tubular string. Top-filling the tubular string in this way may permit the tubular string to be filled with fluid in a controlled manner. Top-filling may permit the tubular string to be filled with fluid of a predetermined density. Top-filling may permit the tubular string to be filled with fluid at a predetermined rate.

The method may comprise isolating an interior of the tubular string from annulus pressure during deployment of the tubular string. This may permit the internal pressure within the tubular string to be controlled independently of annulus pressure. This may permit the tubular string to be deployed into a fluid-filled well when the tubular string is filled with a lower density fluid. This may permit the tubular string to be deployed into a fluid-filled well when the tubular string is filled with a gas such as air. Floating the tubular string into a fluid-filled well in this way may reduce buoyancy of the tubular string.

The method may comprise maintaining the displacement port closed during deployment.

The method may comprise supplying, for example pumping, fluid into the wellbore for control of the well during deployment of the tubular string into the well. Supplying fluid may serve to replace any fluid lost from the wellbore, for example, as a result of fluid flowing from the wellbore into a formation surrounding the wellbore.

It should be understood that any feature defined in relation to one aspect may be provided in combination with any other aspect.

According to a sixth aspect of the present invention there is provided a method for deploying a tubular which includes a plurality of axially spaced transverse fluid ports into a wellbore, comprising:

deploying the tubular into a wellbore through a well control barrier with the transverse fluid ports sealed;

monitoring a condition of the wellbore during deployment of the tubular;

closing the well control barrier to seal against an outer surface of the tubular in response to the monitored condition falling outside an acceptable range;

opening the well control barrier in response to the monitored condition falling within the acceptable range; and continuing deployment of the tubular into the wellbore.

The method may comprise interrupting deployment of the tubular into the wellbore through the well control barrier before closing the well control barrier.

The method may comprise taking remedial action in response to the monitored condition falling outside the acceptable range to thereby return the monitored condition to within the acceptable range.

It should be understood that any feature defined in relation to one aspect may be provided in combination with any other aspect.

BRIEF DESCRIPTION OF THE DRAWINGS

These and other aspects of the present invention will now be described, by way of example only, with reference to the accompanying drawings, in which:

FIGS. 5A and 5B illustrate an alternative plug used to provide a temporary seal to a port of the apparatus of FIG. 1, wherein FIG. 5A shows the plug in its sealed configuration, and FIG. 5B shows the plug in its open configuration; and FIGS. 6A and 6B illustrate a method for deploying an apparatus in accordance with an embodiment of the present invention through a Blow Out Preventor (BOP) into a wellbore, wherein FIG. 6A shows the apparatus being deployed through the BOP when pipe rams of the BOP are open, and FIG. 6B shows the apparatus when deployment has ceased and the pipe rams are closed.

DETAILED DESCRIPTION OF THE DRAWINGS

Figure 1:
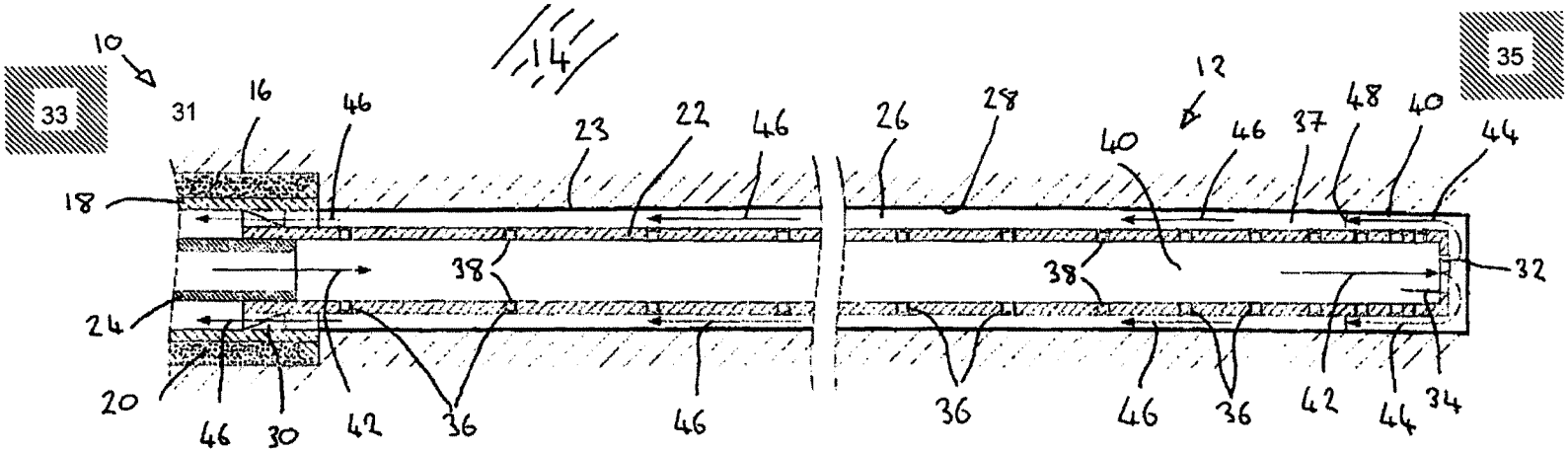
FIG. 1 is a diagrammatic illustration of an apparatus in accordance with an embodiment of the present invention, wherein the apparatus is shown in use displacing a fluid within a drilled bore.

FIG. 1 provides a diagrammatic illustration of upper and lower bore sections 10, 12 which intercept a subterranean reservoir 14 containing a desired target fluid, such as oil or gas. One or both of the bore sections 10, 12 may extend in any orientation, such as vertically or horizontally. As will be described in more detail below, features and aspects of the present invention may permit the lower bore section to extend to a significant depth beyond the upper bore section 10 and permit exploitation of a larger extent of the subterranean reservoir 14 through a single bore. For example, in the present embodiment the upper bore section 10 may extend to a depth of, for example 5486 m (18,000 feet), which may be referred to as a first subterranean reservoir region 33, and the lower bore section 12 may extend for an additional 3048 m (10,000 feet) below this which may be referred to as a second subterranean reservoir region 35.

The upper bore section 10 includes a drilled bore 16 which has been lined with a reservoir liner 18 cemented in place with a cement sheath 20. Although not illustrated in FIG. 1, the liner 18 may be perforated to establish communication with the reservoir 14 and facilitate production of reservoir fluids to surface, for example through known production completion systems. Such known completion systems may also facilitate the upper bore section 10 and associated reservoir section to be appropriately treated, for example stimulated, to initiate and/or maximise production rates. However, some known completion systems and techniques have limitations on their reach within a bore. For example, production strings and associated infrastructure may be incapable of being deployed beyond a particular depth, for example due to frictional engagement with the bore wall and the like. As such, conventional completion techniques may not be utilised in the lower bore section 12, and in many cases extending the bore below the lined section 10 may not be contemplated. The present invention, however, permits extension of the wellbore beyond these conventional completed bore sections, while allowing feasible production rates to be achieved, as will be discussed in detail below.

As will be described in further detail below, the present invention utilises a tubular string or liner 22 which is located within the lower bore section 12 and which can be utilised to perform a treating operation of the bore 12 and/or surrounding formation 14, to permit feasible production rates to be achieved. For example, the treating operation may be performed to remove mud cake 23 deposited on the wall 28 of the bore, and/or to fracture the formation 14. Further, once appropriate treatment has been performed, the tubular string 22 may remain in place to facilitate production of fluid from the reservoir 14 surrounding the lower bore.

Following drilling of the lower bore section 12, the tubular string 22 is run in via a running string 24 such that the string 22 defines an annulus 26 with the wall 28 of the bore 12. The string 22 may be formed from a continuous tubular, or from multiple tubulars connected together in end-to-end relation. Prior to running the string 22, the lower bore 12 may optionally be lined, for example with a slotted liner which includes a number of openings permitting a large surface area of the bore wall 28 to remain exposed. The string 22 is secured to the liner 18 of the upper bore section 10 via a tubing hanger 30 which is initially configured to permit fluid communication between the annulus 26 and the upper bore section 10.

A lower end region of the string 22 includes a displacement port 32 which is capable of being selectively closed, in this embodiment by a flapper valve 34. In the initial configuration shown in FIG. 1 the flapper valve 34 is arranged to open the associated displacement port 32. In the present embodiment the displacement port 32 defines a large diameter, relative to the tubular diameter, to maximise the permitted flow rate through said port 32.

The string 22 comprises a plurality of fluid ports 36 distributed along its length which are provided to permit a treating fluid to be delivered into the annulus 26 along the length of the string 22, to perform a desired treatment within the bore 12 and/or formation 14. Although in the present embodiment a number of ports 36 are provided at a common axial location along the tubular string 22, in other embodiments only a single port at one axial location may be provided.

The annulus 26 will be initially filled with a fluid 37, such as a completion fluid or drilling mud, resident in the bore 12 at the time of running the string 22, and in certain circumstances it may be desirable to displace this fluid from the annulus 26 prior to treating the bore 12 and/or formation 14. For example, if this resident fluid 37 is not removed it may dilute or diminish the effect of a treating fluid. Further, if the resident fluid 37 is not removed it may be forced into the surrounding formation 14, which may not be desirable. The present invention advantageously permits such fluid displacement, as will now described in detail below.

Figure 2:
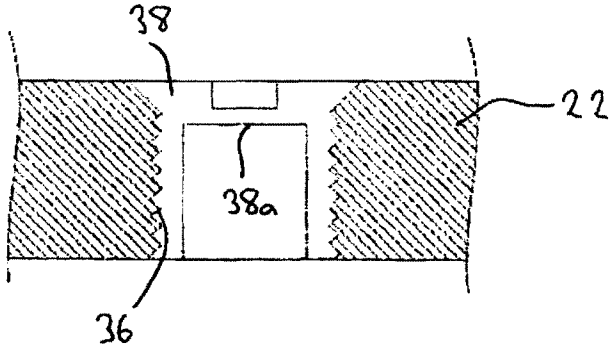
FIG. 2 illustrates a plug used to provide a temporary seal to a port in a wall of the apparatus of FIG. 1.

In the present exemplary embodiment the fluid ports 36 are initially sealed with respective sealing assemblies in the form of plugs 38 threadedly engaged within the ports 36. FIG. 2 provides an enlarged view of a portion of the tubular string 22 in the region of a fluid port 36, showing the associated plug 38, which defines a complete fluid barrier. In the present embodiment, and as will be described in more detail below, each plug 38, or at least a portion of each plug, such as central disk region 38*a*, is capable of being dissolved so that the associated ports 36 may eventually be opened to establish fluid communication between the tubular string 22 and the annulus 26 via the ports 36.

Following location of the string 22 in the bore 12, with the lower displacement port 32 opened and the plugs 38 intact to seal the fluid ports 36, a displacing fluid 40, such as water, is delivered into the string 22 in the direction of arrows 42 to exit the lower end of the string 12 via port 32 and into the annulus 26. This displacing fluid 40 moves upwardly along the annulus 26, in the direction of arrows 44, and thus displaces the resident fluid 37 upwardly, as illustrated by arrows 46, into the upper bore section 10 through the tubing hanger 30. In FIG. 1 a defined interface region 48 is illustrated between the resident fluid 37 and the displacing fluid 44, although in reality the region of the interface may be defined by an intimate mixture of the fluids.

In the present embodiment the plugs 38 within the fluid ports 36 are formed of a material which is dissolvable in the displacing fluid 40, such that prolonged exposure to the displacing fluid 40 causes the plugs 38 to dissolve and ultimately permit the ports 36 to become opened. Such an arrangement provides a largely passive mechanism to open the ports 36, avoiding the requirement to utilise separate tools and mechanical actuators, which may be difficult to deploy and control at the potential depths involved. The plugs 38 may be specifically designed to retain a fluid barrier in each port 36 for a desired period of time, which may be selected to allow the resident fluid 37 to be completely displaced from the annulus 26.

Figure 3:
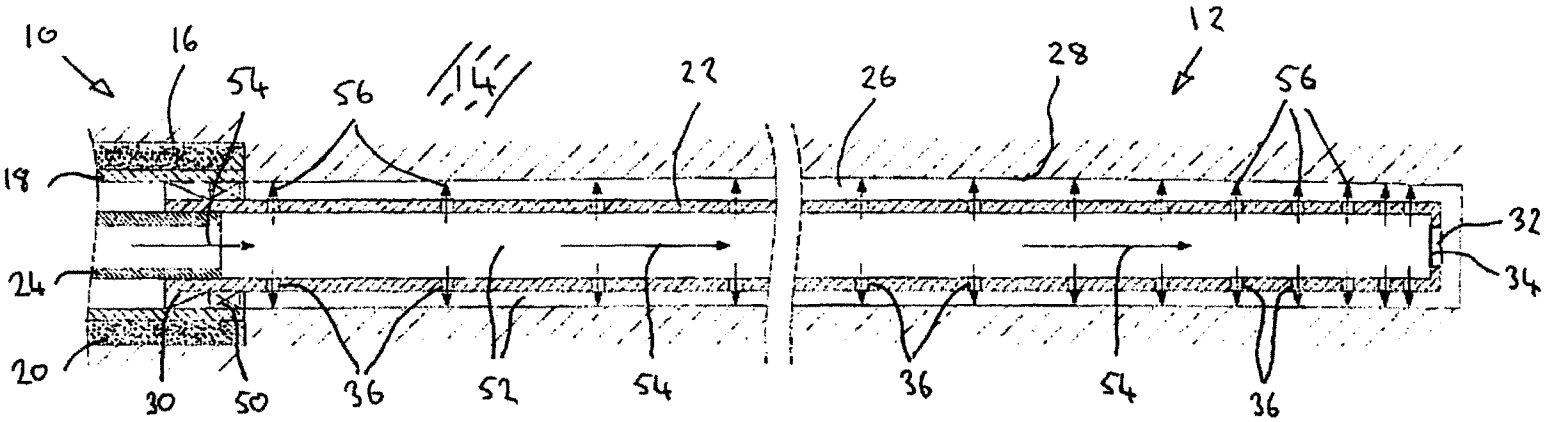
FIG. 3 illustrates the apparatus of FIG. 1 in a subsequent treating operation.

Once the plugs 38 have been dissolved a well treating procedure may be performed, as will now be described with reference to FIG. 3.

A seal 50 is established between the tubular string 22 and liner 18 of the upper bore section 10 to isolate the annulus 26, such that further displacement of any fluid from the annulus 26 is prevented. The lower displacement port 32 is closed by the flapper valve 34. A treating fluid 52, such as an acid, for example hydrochloric acid, is then delivered through the string 22 in the direction of arrows 54, and exits into the annulus 26 via the opened fluid ports 36, in the direction of arrows 56. In such an arrangement the treating fluid 52 may exit into the annulus 26 along the entire length of the string 22. To facilitate an even distribution of the treating fluid 52 the fluid ports 36 are unevenly distributed along the length of the string 22. Specifically, the geometric distribution of the fluid ports 36 is such that the average axial spacing of the fluid ports 36 decreases towards the lower end region of the string 22. This assists to compensate for the friction pressure drop as the treating fluid 52 is delivered along the length of the string 22 towards the lowermost fluid ports.

The treating fluid 52 may function to remove any mud cake 23 (FIG. 1) from the wall 28 of the bore, to decrease any restriction to flow between the formation 14 and annulus 26. Further, the treating fluid 52 may be forced into the formation 14, for example to fracture the formation, perform acid matrix stimulation or the like. In such an arrangement the pressure of the treating fluid 52 within the annulus 26 may be elevated to a sufficient magnitude to permit flow into the formation 14.

In the present embodiment the displacing fluid 40 (FIG. 1) used to displace the original resident fluid 37 (also FIG. 1) may remain present in the annulus 26 upon initiation of well treatment. However, this may be acceptable as the displacing fluid 40 may be selected to be substantially inert to the treating fluid 52 and/or formation 14, and thus have minimal impact to the effect of the treatment performed.

Figure 4:
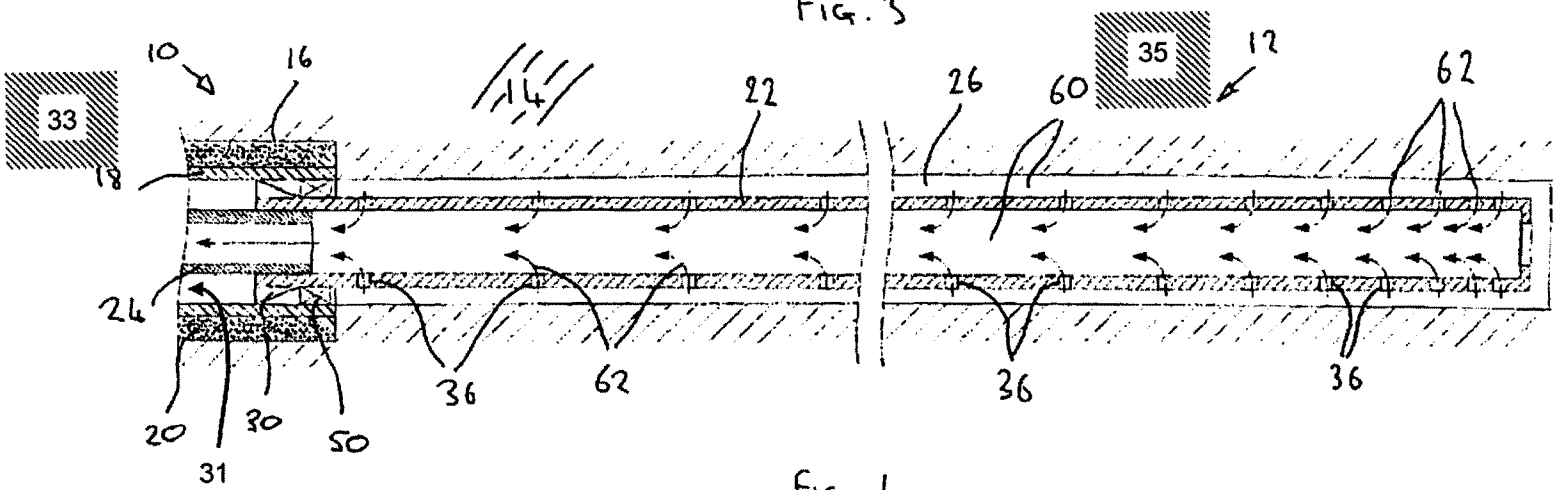
FIG. 4 illustrates the apparatus of FIG. 1 in a subsequent production operation.

Once the treatment is completed the tubular string 22 may remain in-situ and used to support production of fluids from the formation 14, as illustrated in FIG. 4. For example, the pressure within the annulus 26 may be reduced, for example by reducing the flow/pressure of the treating fluid 52, to permit a formation fluid 60, such as a hydrocarbon fluid, to flow from the formation 14 (i.e. the first and second subterranean reservoir regions, 33, 35) and into the annulus 26, and subsequently into the string 22 via the fluid ports 36 in the direction of arrows 62. The formation fluid 60 may be delivered into the upper bore section 10 (e.g. from the first subterranean reservoir region 33 and into the upper bore section 10 through reservoir liner 18 in the direction of arrow 31) and subsequently to surface. In some embodiments the formation fluids 60 may be accommodated by an existing production completion installed within the upper bore section 10.

It should be understood that the embodiment described herein is merely exemplary and that various modifications may be made thereto without departing from the scope of the invention. For example, in the described embodiment the ultimate intention is to support production from a subterranean formation via the tubular string. However, in an alternative embodiment the intention may be to support injection of a fluid into the formation. Further, in the described embodiment the resident fluid is initially displaced with a displacing fluid, and a separate treating fluid is then used to perform treatment. However, in some embodiments the treating fluid may comprise the displacing fluid. That is, the resident fluid may be displaced by the treating fluid.

Figure 5B:
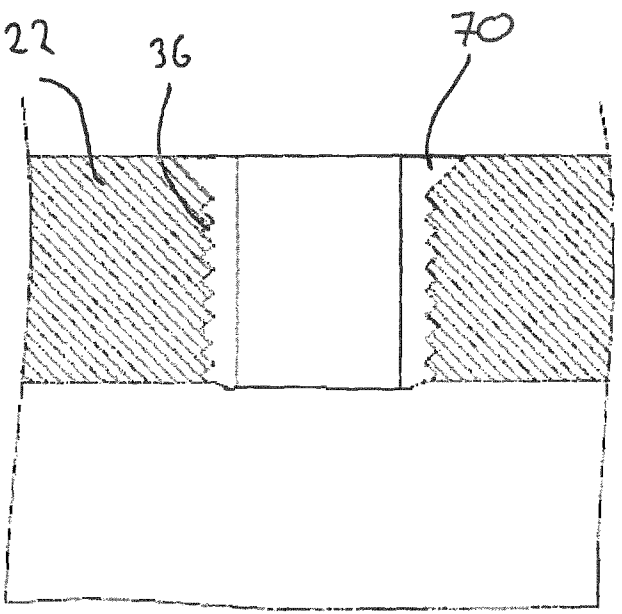
Figure 5A:
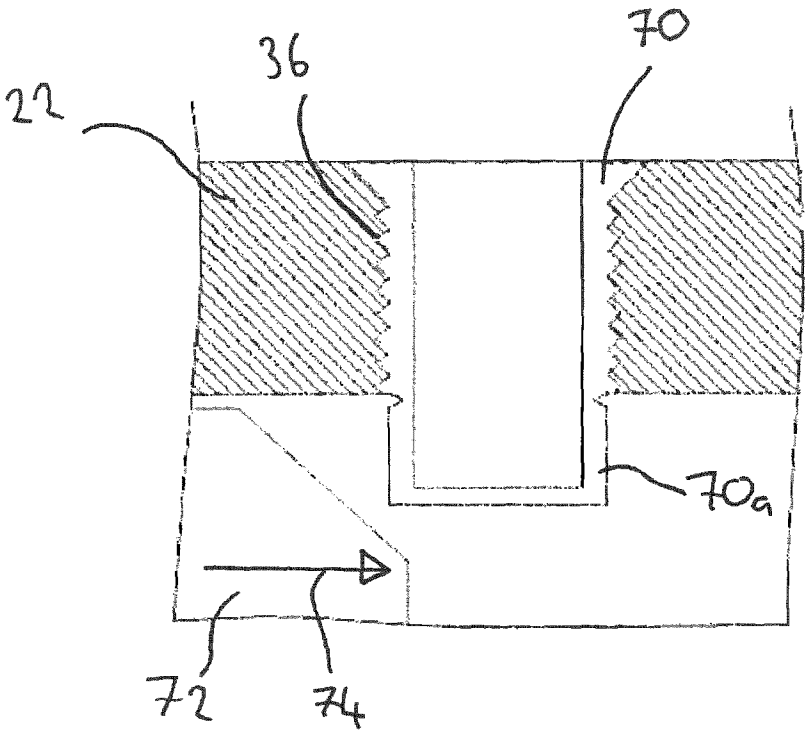

Further, in the above described embodiment the plugs 38 used to initially seal the ports 36 are dissolvable. However, any arrangement may be used which is suitable to provide an initial seal, and which may permit subsequent opening of the ports at a desired time. One such alternative arrangement is illustrated in FIG. 5A, which shows an enlarged view of the tubular string 22 in the region of a port 36. A plug 70 is threadedly engaged within the port 36 and includes a frangible portion 70*a* which extends inside the tubular string 22. In use, a tool, such as a tractor 72 may be displaced through the tubing string 22 in the direction of arrow 74, to break-off the frangible portion 70*a*, thus opening the associated port 36, as illustrated in FIG. 5B.

In the exemplary embodiment described above the resident fluid is displaced upwardly through the annulus by the displacing fluid which is delivered via the tubular string, which is known as forward or short circulation. However, in alternative embodiments the displacing fluid may be delivered into the annulus to displace the resident fluids into the tubular string via the displacement port, known as reverse or long circulation.

In some embodiments it may be desirable to isolate one or more regions of the lower bore section, for example isolate sections within the tubular string and/or within the annulus. Such isolation may facilitate targeted treatment/production from of/from the formation.

In some embodiments ports may be removed by a thermal activator, mechanical activator or the like.

Figure 6A:
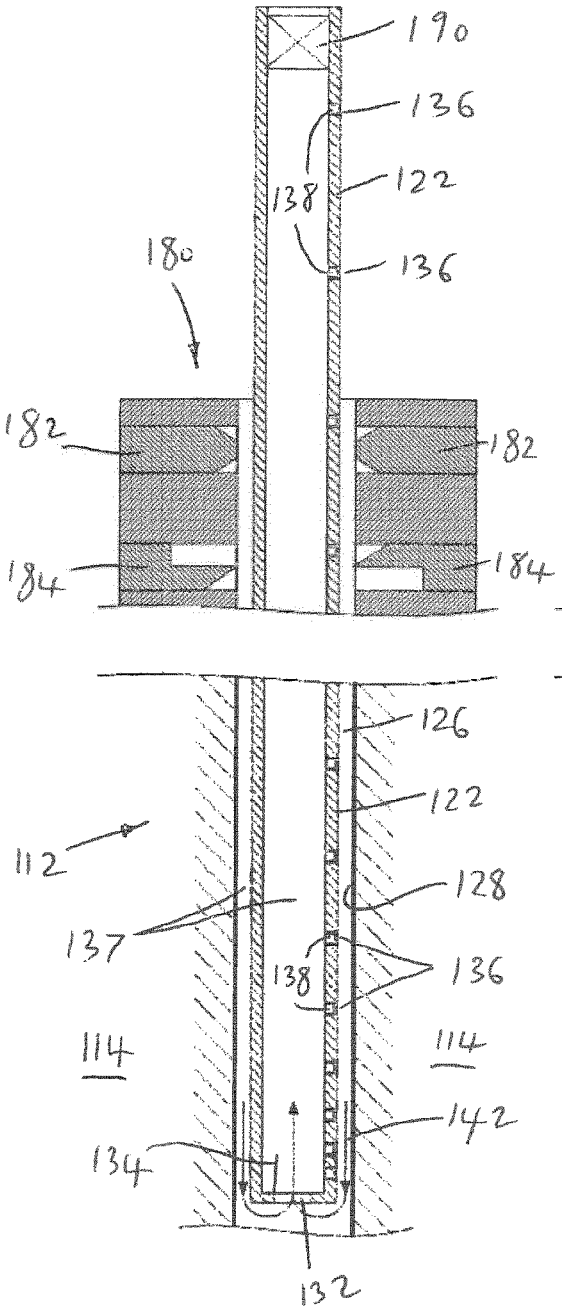
Figure 6B:
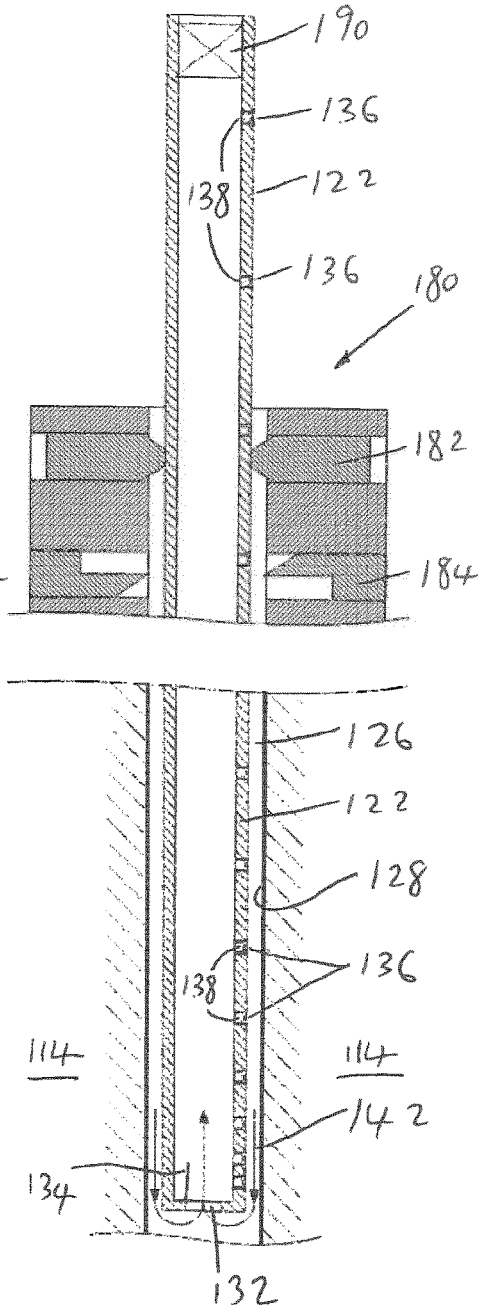

FIGS. 6A and 6B show an alternative embodiment of an apparatus according to the invention in the form of a tubular string 122. The tubular string 122 may, for example, be a Controlled Acid Jet (CAJ) liner. The tubular string 122 shares many like features with the tubular string 22 shown in FIGS. 1 to 5B and, as such, corresponding features share like reference numerals. However, in contrast to the tubular string 22 of FIGS. 1 to 5B, the tubular string 122 comprises only one sealed port 136 at each axial position of the tubular string 122. Each sealed port 136 is sealed by a corresponding sealing assembly in the form of a plug 138.

FIGS. 6A and 6B illustrate a method of deploying the tubular string 122 through a Blow Out Preventor (BOP) generally designated 180 into a lower open hole section 112 of an oil or gas well located below an upper lined section (not shown) of the well. It should be understood that the presence of only one sealed port 136 at each axial position of the tubular string 122 is not essential for deployment through the BOP 180 and that there may be a plurality of sealed ports 136 at each axial position of the tubular string 122. The BOP 180 comprises a pair of pipe rams 182 and a pair of shear rams 184. The tubular string 122 may comprise internal fluid control such as an Internal Blow Out Preventor (IBOP) 190 which may be activated to seal an upper end of the tubular string 122 in the event of an emergency. It should be understood that the tubular string 122 may be connected at an upper end thereof to a running string (not shown) for the purposes of deploying the tubular string 122 through the BOP 180 into the well.

During deployment of the tubular string 122, the pipe rams 182 and the shear rams 184 are open as shown in FIG. 6A to permit the tubular string 122 to be run into the lower open hole bore section 112 of the well. During deployment, the IBOP 190 at the upper end of the tubular string 122 and the flapper valve 134 at the lower end of the tubular string 122 are open to permit resident wellbore fluid 137 to fill the tubular string 122 through a displacement port 132 located at a lower end thereof as indicated by arrows 142. During deployment, fluid may also be pumped from surface via an annulus 126 defined between the tubular string 122 and a wall 128 of the lower open hole section 112 as indicated by arrows 142 so as to maintain control of the well.

In the event of a pressure kick in the well, deployment of the tubular string 122 through the BOP 180 is interrupted and the pipe rams 182 are activated to form a seal against an outer surface of the tubular string 122 as shown in FIG. 6B. In addition, the IBOP 190 is activated to seal the upper end of the tubular string 122. The presence of the plugs 138 in the ports 136 means that the tubular string 122 acts as a pressure barrier so that the pipe rams 182 and the IBOP 190 can act together to seal the well.

Once well control has been re-established, for example, by replacing the resident wellbore fluid 137 with higher density fluid, the pipe rams 182 are de-activated to permit deployment of the tubular string 122 to continue. The IBOP 190 is also de-activated to unseal the upper end of the tubular string 122. Deployment of the tubular string 122 continues until the tubular string 122 reaches the desired position in the lower bore section 112 of the well. Once in the desired position, the tubular string 122 may be used in the treatment of a formation 114 surrounding the lower bore section 112 of the well for the stimulation of the formation 114 as previously described in relation to stimulation of the formation 14 using tubular string 22 with reference to FIGS. 3 and 4.

The invention claimed is:

1. A method for treating and producing from a subterranean region, comprising:

running a tubular string comprising a plurality of sealed fluid ports distributed along a length of the tubular string through a reservoir liner in an upper lined wellbore section which intercepts a first subterranean reservoir region, and into a lower drilled bore section of a drilled bore, the lower drilled bore section intercepting a second subterranean reservoir region, wherein the lower drilled bore section includes a first fluid;

providing fluid communication between the tubular string and an annulus defined between the tubular string and a wall of the drilled bore via a displacement port in a lower end region of the tubular string;

delivering a second fluid into the lower drilled bore section via one of the annulus and the tubular string to displace the first fluid from the annulus;

subsequently opening the sealed fluid ports, and delivering a treating fluid through the tubular string and into the annulus containing the second fluid via the opened fluid ports along the length of the tubular string to treat the subterranean region;

permitting a first production fluid to flow from the second subterranean reservoir region and into the tubular string via at least one opened fluid port of the opened fluid ports; and providing a communication path through a wall of the reservoir liner and permitting a second production fluid to flow from the first subterranean reservoir region and into the upper lined wellbore section through the wall of the reservoir liner such that production fluid is permitted to flow from the second subterranean reservoir region and into the tubular string via the at least one opened fluid port at the same time as production fluid is permitted to flow from the first subterranean reservoir region and into the upper lined wellbore section through the wall of the reservoir liner.

2. The method according to claim 1, comprising using the treating fluid to treat at least one of a portion of the drilled bore, a wall surface of the drilled bore and surrounding geology or rock structure.

3. The method according to claim 1, comprising mounting the tubular string to a liner of the upper lined wellbore section such that fluid communication between said liner and the tubular string is permitted to allow the first fluid to be displaced from the lower drilled bore section.

4. The method according to claim 1, comprising forming a seal between the tubular string and the reservoir liner of the upper lined wellbore section following a desired displacement of the first fluid.

5. The method according to claim 1, wherein the treating fluid comprises the second fluid.

6. The method according to claim 1, wherein the treating fluid comprises a third fluid which is different from the second fluid.

7. The method according to claim 1, comprising cleaning the second subterranean region with the treating fluid.

8. The method according to claim 1, comprising removing a material deposited on the wall of the drilled bore.

9. The method according to claim 1, comprising stimulating geology surrounding the drilled bore using the treating fluid.

10. The method according to claim 1, comprising fracturing geology surrounding the drilled bore using the treating fluid.

11. The method according to claim 1, wherein the treating fluid comprises an acid.

12. The method according to claim 1, wherein the opening opens all of the sealed fluid ports of the tubular string to permit communication of the treating fluid into the annulus along the length of the tubular string.

13. The method according to claim 1, wherein the sealed fluid ports are unevenly distributed along the length of the tubular string.

14. The method according to claim 13, wherein an average axial spacing of the sealed fluid ports decreases towards the lower end region of the tubular string.

15. The method according to claim 1, comprising establishing a pressure differential between the tubular string and the annulus to open at least one of the sealed fluid ports.

16. The method according to claim 1, wherein the opening opens at least one of the sealed fluid ports after a lapse of time.

17. The method according to claim 1, wherein the opening opens at least one of the sealed fluid ports upon expansion of the tubular string in the region of said lcast one sealed fluid port.

18. The method according to claim 1, wherein the opening opens at least one of the sealed fluid ports by at least one of a mechanical activation, a thermal activation and a pressure activation.

19. The method according to claim 1, wherein the upper lined wellbore section accommodates a production completion system.

20. The method according to claim 1, wherein the reservoir liner in the upper lined wellbore section comprises perforations which provides a communication path through the wall of said reservoir liner.

21. The method according to claim 1, comprising installing a completion system within the reservoir liner, wherein the completion system does not extend into the tubular string within the lower drilled bore section.

22. The method according to claim 1, wherein the opening opens at least one of the sealed fluid ports by a chemical activation.

23. The method according to claim 22, wherein the chemical activation is achieved by use of at least one of the second fluid and the treating fluid.

24. The method according to claim 1, comprising closing the displacement port in the lower end region of the tubular string such that the treating fluid is restricted to flow only through the at least one opened fluid port.

25. The method according to claim 24, comprising closing the displacement port before or at a same time as opening the at least one opened fluid port.

26. The method according to claim 1, wherein the tubular string is defined by multiple tubular members coupled together in end-to-end relation.

27. The method according to claim 26, wherein the multiple tubular members comprise a plurality of non-ported tubular members and a plurality of ported tubular members.

28. The method according to claim 1, comprising permitting a fluid to flow from surrounding geology into the annulus and into the tubular string via at least one opened fluid port of the opened fluid ports, following treatment of the subterranean region.

29. The method according to claim 28, comprising injecting a fluid into a surrounding geology via the at least one opened fluid port of the opened fluid ports in the tubular siring, following treatment of the subterranean region.

30. The method according to claim 1, comprising initially sealing at least one particular fluid port by mounting a sealing assembly relative to a selected sealed fluid port of the plurality of sealed fluid ports, and then activating the sealing assembly to open the selected sealed fluid port.

31. The method according to claim 30, wherein the sealing assembly comprises a plug mounted within an associated fluid port of the plurality of sealed fluid ports.

32. The method according to claim 30, wherein the opening includes breaking a frangible component of the sealing assembly to open the selected sealed fluid port.

33. The method according to claim 32, wherein the opening includes breaking the frangible component by at least one of a mechanical force and exposure to a pressure differential.

34. The method according to claim 30, wherein the sealing assembly comprises a sleeve mounted concentrically with the tubular string and configured to be moved from a first position in which the selected sealed fluid port is closed, to a second position in which the selected sealed fluid port is opened.

35. The method according to claim 30, wherein the opening includes chemically activating the sealing assembly to open the selected sealed fluid port.

36. The method according to claim 35, wherein the chemically activating chemically degrades at least a portion of the sealing assembly to open the selected sealed fluid port.

37. The method according to claim 36, wherein the chemically degrading includes dissolving.

38. The method according to claim 35, wherein the chemically activating chemically degrades at least a portion of the sealing assembly in at least one of the second fluid and the treating fluid.

39. The method according to claim 35, wherein the chemically activating chemically degrades at least a portion of the sealing assembly over a time period prior to eventual opening of the selected sealed fluid port.

40. The method according to claim 1, wherein the running runs the tubular string through a well control barrier.

41. The method according to claim 40, wherein the well control barrier is operable to provide a seal against an outer surface of the tubular string.

42. The method according to claim 40, wherein the well control barrier comprises a blow out preventor.

43. The method according to claim 40, comprising interrupting running of the tubular string through the well control barrier.

44. The method according to claim 40, comprising closing the well control barrier so as to provide a seal against an outer surface of the tubular string.

45. The method according to claim 44, comprising opening the well control barrier and continuing to run the tubular string through the well control barrier.

46. The method according to claim 40, comprising sealing an interior of the tubular string.

47. The method according to claim 46, comprising unsealing the interior of the tubular string before continuing to run the tubular string through the well control barrier.

* * * * *